US012022856B2

(12) United States Patent
Li et al.

(10) Patent No.: US 12,022,856 B2
(45) Date of Patent: Jul. 2, 2024

(54) SLOW-RELEASE FRAGRANCE AND APPLICATION THEREOF IN A TOBACCO PRODUCT WITH CHINESE-STYLE FLAVOR

(71) Applicant: CHINA TOBACCO GUANGDONG INDUSTRIAL CO., LTD., Guangdong (CN)

(72) Inventors: Feng Li, Guangdong (CN); Xi Liu, Guangdong (CN); Yanjun Zhang, Guangdong (CN); Jian Zeng, Guangdong (CN); Jinming Wu, Guangdong (CN); Jing Hu, Guangdong (CN); Yibo Liu, Guangdong (CN); Yuming Li, Guangdong (CN)

(73) Assignee: CHINA TOBACCO GUANGDONG INDUSTRIAL CO., LTD., Guangdong (CN)

( * ) Notice: Subject to any disclaimer, the term of this patent is extended or adjusted under 35 U.S.C. 154(b) by 791 days.

(21) Appl. No.: 17/259,553

(22) PCT Filed: Jul. 12, 2019

(86) PCT No.: PCT/CN2019/095699
§ 371 (c)(1),
(2) Date: Jan. 12, 2021

(87) PCT Pub. No.: WO2020/258386
PCT Pub. Date: Dec. 30, 2020

(65) Prior Publication Data

US 2021/0321658 A1 Oct. 21, 2021

(30) Foreign Application Priority Data

Jun. 27, 2019 (CN) ..... 201910568106.4

(51) Int. Cl.
*A24B 15/30* (2006.01)
*A24B 13/02* (2006.01)
*A24B 15/14* (2006.01)

(52) U.S. Cl.
CPC ..... *A24B 15/303* (2013.01); *A24B 13/02* (2013.01); *A24B 15/14* (2013.01)

(58) Field of Classification Search
CPC ..... A24B 15/12; A24B 15/24; A24B 15/303; A24B 3/14; A24D 1/20
See application file for complete search history.

(56) References Cited

FOREIGN PATENT DOCUMENTS

| | | | |
|---|---|---|---|
| CN | 103504464 | A | 1/2014 |
| CN | 104585863 | | 5/2015 |
| CN | 104770863 | A | 7/2015 |
| CN | 104824824 | | 8/2015 |
| CN | 104856215 | A | 8/2015 |
| CN | 105054280 | A | 11/2015 |
| CN | 105661651 | A | 6/2016 |
| CN | 105686061 | | 6/2016 |
| CN | 106221935 | | 12/2016 |
| CN | 106221935 | A | 12/2016 |
| CN | 106244330 | | 12/2016 |
| CN | 106244330 | A | 12/2016 |
| CN | 106263009 | | 1/2017 |
| CN | 106263009 | A | 1/2017 |
| CN | 106811294 | | 6/2017 |
| CN | 106811295 | | 6/2017 |
| CN | 107212467 | A | 9/2017 |
| CN | 107365628 | A | 11/2017 |
| CN | 107692303 | | 2/2018 |
| CN | 108065456 | | 5/2018 |
| CN | 108143003 | A | 6/2018 |
| CN | 108338399 | | 7/2018 |
| CN | 108968136 | A | 12/2018 |
| CN | 109619673 | | 4/2019 |
| CN | 109645546 | A | 4/2019 |
| JP | 2010506594 | A | 3/2010 |

OTHER PUBLICATIONS

"CN109619673A—Cigarette Spansule and Preparation Method Thereof and Cigarette Filter." Google Patents, patents.google.com/patent/CN109619673A/en?oq=cn109619673. Accessed Oct. 30, 2023. (Year: 2019).*

Xu Yong, "Study on the Application of Chinese Herbal Extracts in Cigarettes" Chinese Master's Theses Full-Text Database (Engineering Science and Technology I), Sep. 2008, submit with English abstract, pp. 1-142.

"International Search Report (Form PCT/ISA/210) of PCT/CN2019/095699," mailed on Mar. 27, 2020, with English translation thereof, pp. 1-6.

* cited by examiner

*Primary Examiner* — Michael H. Wilson
*Assistant Examiner* — Stephanie Lynn Moore
(74) *Attorney, Agent, or Firm* — Samson G. Yu

(57) ABSTRACT

The invention provides a slow-release fragrance and an application thereof in a tobacco product with Chinese-style flavor. The slow-release fragrance of the invention includes the following constituents in percentage by mass: 5% to 50% of a tobacco extract and 50% to 95% of a tangerine peel extract.

8 Claims, No Drawings

SLOW-RELEASE FRAGRANCE AND APPLICATION THEREOF IN A TOBACCO PRODUCT WITH CHINESE-STYLE FLAVOR

CROSS-REFERENCE TO RELATED APPLICATION

This application is a 371 of international application of PCT application serial no. PCT/CN2019/095699, filed on Jul. 12, 2019, which claims the priority benefit of China application no. 201910568106.4, filed on Jun. 27, 2019. The entirety of each of the above mentioned patent applications is hereby incorporated by reference herein and made a part of this specification.

BACKGROUND

Technical Field

The present invention relates to the technical field of tobacco products, and more particularly, to a slow-release fragrance and an application thereof in a tobacco product with Chinese-style flavor.

Description of Related Art

With the increasingly higher quality requirement on tobacco products in the market, novel tobaccos have a great development space, wherein it is even a current hot spot to develop tobacco products with Chinese-style flavor. As a core technology of a tobacco industry, development and research of related tobacco flavors and fragrances have become one of the keys to highlight flavor characteristics of Chinese-style cigarettes and create a Chinese cigarette style. There are many researches on the flavors and fragrances in the existing novel tobacco technology, without highlighting the Chinese style. Development and application of related novel cigarette flavors and fragrances are an important way to solve the above problems.

Tangerine peel is bitter, pungent and warm in nature, acts on a lung channel and a spleen channel, and has effects of regulating qi-flowing for strengthening spleen, removing dampness and eliminating phlegm. The tangerine peel abounds in Guangdong, Fujian, Chongqing, Zhejiang and other regions. It is pointed out in Chinese Materia Medica for Daily Use that: only the tangerine peel in Guangdong is the best, the tangerine peel in other regions takes the second place, and the tangerine peel stored for many years is even better. The quality of the tangerine peel in Guangdong is superior in Sihui and Xinhui regions. Modern pharmacological research also suggests that the tangerine peel has effects of eliminating phlegm, resisting ulcer, promoting gastrointestinal peristalsis, dilating coronary artery, and the like. The tangerine peel and an extract thereof are mostly used in the fields of food and related traditional Chinese medicines, and it is also disclosed that the tangerine peel is applied in regulating a tobacco taste. CN107692303A in the prior art discloses a preparation method of a heat-not-burn tobacco sheet, wherein a biologically treated concentrated solution obtained by mixing and extracting, concentrating and biologically treating tangerine peel with a microbially treated tobacco leaf is disclosed, which has a Maillard reaction with a related modifier to prepare a coating material, and the coating material is applied to the tobacco sheet to eliminate objectionable smell such as wood odor and endow the tangerine peel with aroma. However, there is no relevant research on uniformity and persistence of the tangerine peel aroma in art, and clarity and prominence of the Chinese type flavor are not well manifested.

SUMMARY

A technical problem to be solved by the present invention is to overcome the defects and deficiencies in development of existing cigarettes with Chinese-style flavor, especially the deficiency of insufficiently showing a clear Chinese-style flavor, and to provide a slow-release fragrance, which contains a tangerine peel extract and a tobacco extract, so that uniformity and durability of the slow-release fragrance can be improved, thus better endowing more complete and clear aroma and taste of the tangerine peel and highlighting the clear Chinese-style flavor.

An objective of the present invention is to provide an application of the above-mentioned slow-release fragrance in a tobacco product with Chinese-style flavor.

Another objective of the present invention is to provide a base material of a tobacco cigarette with Chinese-style flavor.

Another objective of the present invention is to provide a reconstituted tobacco leaf.

Another objective of the present invention is to provide a heat-not-burn cigarette.

The above objectives of the present invention are achieved by the following technical solutions.

A slow-release fragrance includes the following constituents in percentage by mass: 5% to 50% of a tobacco extract and 50% to 95% of a tangerine peel extract.

The tobacco extract can make up for a deficiency of tobacco characteristics, and addition of the tangerine peel extract can strengthen the characteristic style of the Chinese-style flavor. However, a ratio of the two is very important. Because the above extracts are baked at a lower temperature for people to suck, performances of the two at different temperatures are different. Compared with a single tangerine peel extract, experiments show that the slow-release fragrance of the present invention has obvious characteristic rhyme and lasting release at a lower temperature.

The tangerine peel of the present invention is preferably selected from Xinhui *Citrus reticulata* tangerine peel. The Xinhui *Citrus reticulata* tangerine peel of the present invention includes one or a mixture of two or more tangerine peels produced from Xinhui Tianma, Meijiang, Chakeng, Dongjia, Sanjiang, Nantan, Xiaogang, Daze, Shuangshui, Luokeng, Gujing, Siqian, Yaxi, Shadui and Ya'nan.

Preferably, the Xinhui *Citrus reticulata* tangerine peel includes one or mixture of two or more tangerine peels of orange peel, reddish peel and red peel in different harvesting periods. The slow-release fragrance of the present invention can obviously improve the smoking stability and durability of the heat-not-burn cigarette, and endow more complete and clearer tangerine peel aroma and taste.

Preferably, the slow-release fragrance includes the following constituents in percentage by mass: 10% to 40% of the tobacco extract and 60% to 90% of the tangerine peel extract.

Preferably, the tobacco extract and the tangerine peel extract are selected from one or more of an essential oil, a pure oil, an extractum and a tincture, wherein the tobacco and tangerine peel essential oil and/or pure oil accounts for 0% to 30% of a total mass of the slow-release fragrance, and the tobacco and tangerine peel extractum and/or tincture accounts for 70% to 100% of the total mass of the slow-release fragrance.

It should be noted that there are many forms of tobacco extracts and tangerine peel extracts. Different extraction forms, such as essential oil, pure oil, extractum, tincture, etc., not only have relevant differences in the extracted effective constituents, but also have differences in overall solubility of the extract and the uniformity of a dissolution system. It is inadvertently found by the inventors that an extract system obtained according to a specific compatibility mode of the present invention is more uniform and stable, and the slow release of the aroma substances is more continuous and uniform.

A volatile oil prepared by a steam distillation method is employed as the essential oil, which plays a role in compensating top note. The pure oil is extracted by petroleum ether, and then a fat-soluble component treated by molecular distillation plays a role of main aroma. The extractum is a mixture by reflux extraction and concentration of 95% ethanol which plays a role of base note. The tincture is an extract of propylene glycol, glycerol or a mixture thereof, which plays a role of harmonizing aroma. The tobacco extract and the tangerine peel extract are mixed to harmonize fusion of the cigarette aroma and the tangerine peel aroma. The tangerine peel essence has the functions of increasing the aroma and durability. The aroma of the cigarette is a comprehensive situation, including main aroma, base note, other auxiliary aroma, and expressed in forms of top note, smell aroma, etc. The invention can realize the overall improvement of the comprehensive aroma by reasonable compatibility of various extracts.

Preferably, the tobacco and tangerine peel essential oil and/or pure oil accounts for 0% to 5% of the total mass of the slow-release fragrance, and the tobacco and tangerine peel extractum and/or tincture accounts for 90% to 100% of the total mass of the slow-release fragrance.

An application of the slow-release fragrance in a tobacco product with Chinese-style flavor is also within the scope of protection of the present invention.

The present invention also protects a base material of a tobacco cigarette with Chinese-style flavor, including the following constituents in percentage by mass: 10 to 60 parts of a tobacco powder, 15 to 90 parts of a tangerine peel powder, 10 to 35 parts of the slow-release fragrance, 10 to 50 parts of a smoke-producing agent, 2 to 20 parts of a fiber, 0.5 to 10 parts of an adhesive, and 10 to 40 parts of water.

In addition to the related slow-release fragrance (tangerine peel fragrance), the base material of the present invention also contains the tangerine peel powder, and the tangerine peel powder and the tangerine peel essence are added simultaneously. Such combination is due to the lasting aroma release of the tangerine peel essence, quick heating and strong aroma of the tangerine peel powder, so as to achieve the effects of ensuring outstanding aroma and lasting aroma of the tangerine peel and reducing the cost.

In particular, the smoke-producing agent of the present invention may be propylene glycol and/or glycerol.

The fiber of the present invention may be one or a mixed fiber of more of a coniferous wood fiber, a hardwood fiber, a flax fiber or a bamboo fiber. In process of papermaking with fiber, a beating degree indicates a water filtering speed of a pulp, and comprehensively reflects degrees that the fiber is cut, swelled, devillicated, and fibrillated. When the beating degree is too low, outer layers of a primary wall and a secondary wall of the fiber are not well broken, and the cutting, swelling, devillicating and fibrillating of the fiber are substandard, which leads to phenomena of rapid dehydration of a web portion, poor fiber bonding and uneven texture during papermaking, thus affecting the uniformity, strength and smoothness of the fiber texture. When the beating degree is too high, it is difficult to filter water at the web portion, and a waterline is prolonged, resulting in high moisture content, low strength and broken ends of the wet fiber. Moreover, according to different fiber raw materials, it is necessary to adjust the beating degree to obtain fibers with strength, smoothness and tissue uniformity that meet the requirements. Therefore, the beating degree of the fiber is preferably 20 SR° to 80 SR°, which can better interact with aroma substances.

The adhesive of the present invention may be one or a mixed adhesive of more of a CMC, a guar gum, a chitosan and the like.

Preferably, the base material of the tobacco cigarette with Chinese-style flavor includes 30 to 60 parts of the tobacco powder, 20 to 60 parts of the tangerine peel powder, and 10 to 20 parts of the slow-release fragrance.

For example, the constituents may be 30 parts of the tobacco powder, 20 parts of the tangerine peel powder, 15 parts of the slow-release fragrance, 30 parts of the smoke-producing agent, 10 parts of the fiber, 5 parts of the adhesive, and 20 parts of water.

Alternatively, the constituents may be 60 parts of the tobacco powder, 60 parts of the tangerine peel powder, 20 parts of the slow-release fragrance, 30 parts of the smoke-producing agent, 10 parts of the fiber, 5 parts of the adhesive, and 20 parts of the water.

Preferably, grain sizes of the tangerine peel powder and the tobacco powder are 80 meshes to 400 meshes.

The present invention further protects a reconstituted tobacco leaf which is prepared by the base material of the tobacco cigarette with Chinese-style flavor mentioned above, and a moisture content of the reconstituted tobacco leaf is 5% to 14%.

According to the reconstituted tobacco leaf of the present invention, it is possible to use the above-mentioned base material, control the moisture content of the base material to be a level of 10% to 40%, and prepare the reconstituted tobacco leaf with Chinese-style flavor for the heat-not-burn cigarette through a reconstituted tobacco leaf production device of a rolling process, wherein a moisture content of the reconstituted tobacco leaf is 5% to 14%;

it is also possible to use the above-mentioned base material, control the moisture content of the base material to be a level of 60% to 80%, and prepare the reconstituted tobacco leaf with Chinese-style flavor for the heat-not-burn cigarette through a reconstituted tobacco leaf production device of a thick pulp process, wherein a moisture content of the reconstituted tobacco leaf is 5% to 14%;

it is also possible to use the above-mentioned base material, control the moisture content of the base material to be a level of 50% to 70%, and prepare the reconstituted tobacco leaf with Chinese-style flavor for the heat-not-burn cigarette through a dip-coating or spray-coating technology of a reconstituted tobacco leaf production device of a papermaking process, wherein a moisture content of the reconstituted tobacco leaf is 5% to 14%; and it is also possible to use the above-mentioned base material, control the moisture content of the base material to be a level of 5% to 10% and control the grain size of the base material to be 80 meshes to 200 meshes, and prepare the reconstituted tobacco leaf with Chinese-style flavor for the heat-not-burn cigarette through a dusting technology of a reconstituted tobacco leaf production device of a dry process, wherein a moisture content of the reconstituted tobacco leaf is 5% to 14%.

The present invention further protects a heat-not-burn cigarette, wherein the heat-not-burn cigarette includes 0% to 55% of a formula leaf group cut tobacco, 0% to 40% of an expanded cut tobacco, and 20% to 84% of a cut tobacco of the reconstituted tobacco leaf.

For example, the heat-not-burn cigarette may include 0% of the formula leaf group cut tobacco, 16% of the expanded cut tobacco, and 84% of the cut tobacco of the reconstituted tobacco leaf.

In one embodiment, the heat-not-burn cigarette may include 55% of the formula leaf group cut tobacco, 0% of the expanded cut tobacco, and 45% of the cut tobacco of the reconstituted tobacco leaf;

In other embodiment, the heat-not-burn cigarette may include 40% of the formula leaf group cut tobacco, 40% of the expanded cut tobacco, and 20% of the cut tobacco of the reconstituted tobacco leaf;

In another embodiment, the heat-not-burn cigarette may include 25% of the formula leaf group cut tobacco, 25% of the expanded cut tobacco, and 50% of the cut tobacco of the reconstituted tobacco leaf.

A cut tobacco production specification of the cut tobacco of the reconstituted tobacco leaf with Chinese-style flavor of the present invention is 5 mm to 50 mm in length, 0.1 mm to 0.3 mm in thickness and 0.6 mm to 1.2 mm in width.

Different cut tobacco sizes, including length, thickness and width, affect a physical strength of the cut tobacco on one hand, consider adaptability of on-machine rolling, and also consider whether a packing value or density of a coiling thickness, as well as a sucking resistance, a ventilation effect and a hardness of a tobacco section meet the requirements. When the size of the cut tobacco is too large, it is not conducive to rolling, especially the cigarette becomes thinner, which makes the production more difficult. However, when the size is too small, the cut tobacco is dense to result in an insufficient space structure, which is not only easy to make the cut tobacco fall out, but also affects ventilation. Especially when a heating element is inserted into the cut tobacco for heating, an influence of the heating element on a physical shape and physical parameters of a tobacco matrix shall be considered, and a structure firmness of the cut tobacco shall also be considered to prevent the cut tobacco from falling during use or when quitting the cigarette. When necessary, the cut tobaccos with the above sizes shall be reprocessed, so that the above-mentioned regular and smooth cut tobaccos can increase elasticity and bending degrees, so that the cut tobaccos can be interlaced with each other and ensure the structural stability of the tobacco matrix. The heat-not-burn cigarette meeting the requirements can be prepared by using the above-mentioned formula cut tobaccos through a cigarette molding device.

According to the present invention, related expanded cut tobaccos are controlled to be a level of 5% to 20%; by controlling an expansion amount, a density and a filling value of the cigarette are adjusted, and a water content of the formula cut tobacco is also adjusted, which, on one hand, is convenient to roll on the machine, and, on the other hand, forms a reasonable cut tobacco structure through reasonable setting of the filling value and the density, improves a heat transfer efficiency and sensory quality, and may also improve the overall stability of the heat-not-burn cigarette product in use; moreover, the cigarette product is not easy to fall off.

The reconstituted tobacco leaf with Chinese-style flavor of the present invention may also be used in traditional cigarettes, which endows smoke of the cigarette with mellow, sweet and supple characteristics of the tangerine peel on one hand, and has functions of regulating qi-flowing for strengthening spleen, removing dampness and eliminating phlegm on the other hand.

Compared with the prior art, the present invention has the following beneficial effects.

(1) The present invention provides the slow-release fragrance containing the tangerine peel extract and the tobacco extract, which endows the smoke with mellow, sweet and supple characteristics of the tangerine peel on one hand, and has functions of regulating qi-flowing for strengthening spleen, removing dampness and eliminating phlegm on the other hand.

(2) The slow-release aroma of the slow-release fragrance according to the present invention is more uniform and lasting, and a content of aroma substances in the smoke after half a year can still be kept at about 80%, which endows more complete and clearer aroma and taste of the tangerine peel, and highlights the Chinese-style flavor, and comprehensive scores of the aroma, the smoke amount and miscellaneous gas can still reach 8.

(3) The heat-not-burn tobacco product with Chinese-style flavor according to the present invention employs an authentic tangerine peel with Lingnan characteristics, has local characteristics, and is stable in source and quality, and can satisfy industrial production requirements.

DESCRIPTION OF THE EMBODIMENTS

The present invention will be further described below with reference to the specific embodiments, but the embodiments are not intended to limit the present invention in any form. Unless otherwise indicated, the raw material reagents employed in the present invention are conventionally purchased raw material reagents.

Embodiment 1

A slow-release fragrance included the following constituents in percentage by mass: 50% of a tobacco extract and 50% of a tangerine peel extract, wherein a tobacco and tangerine peel essential oil and pure oil accounted for 5% of the total mass of the slow-release fragrance, and a tobacco and tangerine peel extractum and tincture accounted for 95% of the total mass of the slow-release fragrance.

Embodiment 2

A slow-release fragrance included the following constituents in percentage by mass: 5% of a tobacco extract and 95% of a tangerine peel extract, wherein a tobacco and tangerine peel essential oil and pure oil accounted for 30% of the total mass of the slow-release fragrance, and a tobacco and tangerine peel extractum and tincture accounted for 70% of the total mass of the slow-release fragrance.

Embodiment 3

A slow-release fragrance included the following constituents in percentage by mass: 10% of a tobacco extract and 90% of a tangerine peel extract, wherein the tobacco extract and the tangerine peel extract were 100% mixed extracts of an extractum and a tincture.

Embodiment 4

A slow-release fragrance included the following constituents in percentage by mass: 40% of a tobacco extract and 60% of a tangerine peel extract, wherein a tobacco and tangerine peel essential oil and pure oil accounted for 5% of the total mass of the slow-release fragrance, and a tobacco and tangerine peel extractum and tincture accounted for 95% of the total mass of the slow-release fragrance.

Embodiment 5

A base material of a tobacco cigarette with Chinese-style flavor included the following constituents in percentage by mass: 10 parts of a tobacco powder, 15 parts of a tangerine peel powder, 10 parts of a slow-release fragrance, 30 parts of a smoke-producing agent, 10 parts of a fiber, 5 parts of an adhesive, and 20 parts of water.

Embodiment 6

A base material of a tobacco cigarette with Chinese-style flavor included the following constituents in percentage by mass: 60 parts of a tobacco powder, 90 parts of a tangerine peel powder, 35 parts of a slow-release fragrance, 30 parts of a smoke-producing agent, 10 parts of a fiber, 5 parts of an adhesive, and 20 parts of water.

Embodiment 7

A base material of a tobacco cigarette with Chinese-style flavor included the following constituents in percentage by mass: 30 parts of a tobacco powder, 20 parts of a tangerine peel powder, 15 parts of a slow-release fragrance, 30 parts of a smoke-producing agent, 10 parts of a fiber, 5 parts of an adhesive, and 20 parts of water, wherein grain sizes of the tangerine peel powder and the tobacco powder were 200 meshes.

Embodiment 8

A base material of a tobacco cigarette with Chinese-style flavor included the following constituents in percentage by mass: 60 parts of a tobacco powder, 60 parts of a tangerine peel powder, 20 parts of a slow-release fragrance, 30 parts of a smoke-producing agent, 10 parts of a fiber, 5 parts of an adhesive, and 20 parts of water, wherein grain sizes of the tangerine peel powder and the tobacco powder were 200 meshes.

Embodiment 9

A heat-not-burn cigarette included 16% of an expanded cut tobacco, and 84% of a cut tobacco of a reconstituted tobacco leaf, wherein the cut tobacco of the reconstituted tobacco leaf was prepared by the base material of the tobacco cigarette with Chinese-style flavor according to Embodiment 8, and a moisture content of the reconstituted tobacco leaf was 10%. The cut tobacco of the reconstituted tobacco leaf was 30 mm in length, 0.2 mm in thickness, and 1.0 mm in width.

Embodiment 10

A heat-not-burn cigarette included 55% of a formula leaf group cut tobacco and 45% of a cut tobacco of a reconstituted tobacco leaf, wherein the cut tobacco of the reconstituted tobacco leaf was prepared by the base material of the tobacco cigarette with Chinese-style flavor according to Embodiment 8, and a moisture content of the reconstituted tobacco leaf was 10%. The cut tobacco of the reconstituted tobacco leaf was 30 mm in length, 0.2 mm in thickness, and 1.0 mm in width.

Embodiment 11

A heat-not-burn cigarette included 40% of a formula leaf group cut tobacco, 40% of an expanded cut tobacco, and 20% of a cut tobacco of a reconstituted tobacco leaf, wherein the cut tobacco of the reconstituted tobacco leaf was prepared by the base material of the tobacco cigarette with Chinese-style flavor according to Embodiment 8, and a moisture content of the reconstituted tobacco leaf was 10%. The cut tobacco of the reconstituted tobacco leaf was 30 mm in length, 0.2 mm in thickness, and 1.0 mm in width.

Embodiment 12

A heat-not-burn cigarette included 25% of a formula leaf group cut tobacco, 25% of an expanded cut tobacco, and 50% of a cut tobacco of a reconstituted tobacco leaf, wherein the cut tobacco of the reconstituted tobacco leaf was prepared by the base material of the tobacco cigarette with Chinese-style flavor according to Embodiment 8, and a moisture content of the reconstituted tobacco leaf was 10%. The cut tobacco of the reconstituted tobacco leaf was 30 mm in length, 0.2 mm in thickness, and 1.0 mm in width.

Comparative Example 1

A base material of a tobacco cigarette with Chinese-style flavor included the following constituents in percentage by mass: 60 parts of a tobacco powder, 20 parts of the slow-release fragrance according to Embodiment 1, 30 parts of a smoke-producing agent, 10 parts of a fiber, 5 parts of an adhesive, and 20 parts of water, wherein a grain size of the tobacco powder was 200 meshes.

Comparative Example 2

A base material of a tobacco cigarette with Chinese-style flavor included the following constituents in percentage by mass: 60 parts of a tobacco powder, 5 parts of a tangerine peel powder, 30 parts of the slow-release fragrance according to Embodiment 1, 30 parts of a smoke-producing agent, 10 parts of a fiber, 5 parts of an adhesive, and 20 parts of water, wherein a grain size of the tobacco powder was 200 meshes.

Comparative Example 3

A base material of a tobacco cigarette with Chinese-style flavor included the following constituents in percentage by mass: 60 parts of a tobacco powder, 20 parts of a tangerine peel powder, 30 parts of a slow-release fragrance, 30 parts of a smoke-producing agent, 10 parts of a fiber, 5 parts of an adhesive, and 20 parts of water, wherein a grain size of the tobacco powder was 200 meshes, and the slow-release fragrance was a tangerine peel extract.

Result Detection (1) Sensory Evaluation of Sucking

The above-mentioned slow-release fragrances and the base materials of the tobacco cigarette with Chinese-style flavor were prepared into the heat-not-burn cigarettes, including 12 embodiments and 3 comparative examples, and then sensory evaluation of sucking was carried out. The evaluation criteria were as follows: a ten-score system was employed. For the aroma, 1 to 3 scores indicated insufficient aroma, 4 to 6 scores indicated moderate aroma, 7 to 8 scores indicated relatively sufficient aroma, and 9 to 10 scores indicated extremely sufficient characteristic aroma. For the smoke amount: 1 to 3 scores indicated small smoke amount, 4 to 6 scores indicated moderate smoke amount, 7 to 8 scores indicated relatively sufficient smoke amount, and 9 to 10 scores indicated extremely sufficient smoke amount. For the miscellaneous gas, 1 to 3 scores indicated obvious miscellaneous gas, 4 to 6 scores indicated relatively obvious miscellaneous gas, 7 to 8 scores indicated slight miscellaneous gas, and 9 to 10 scores indicated no miscellaneous gas. The comprehensive evaluation referred to the overall evaluation on the aroma, the smoke amount, the smoke temperature, and the miscellaneous gas and release consistency, 1 to 3 scores indicated poor comprehensive performances, 4 to 6 scores indicated general comprehensive performances, 7 to 8 scores indicated relatively good comprehensive performances, and 9 to 10 scores indicated good comprehensive performances.

Evaluation results were as shown in Table 1.

TABLE 1

| Serial number | Aroma | Smoke amount | Miscellaneous gas | Comprehensive evaluation |
|---|---|---|---|---|
| Embodiment 1 | 8 | 9 | 8 | 8 |
| Embodiment 2 | 8 | 9 | 8 | 8 |
| Embodiment 3 | 9 | 8 | 8 | 8 |
| Embodiment 4 | 8 | 9 | 9 | 9 |
| Embodiment 5 | 9 | 9 | 9 | 9 |
| Embodiment 6 | 8 | 8 | 9 | 8 |
| Embodiment 7 | 8 | 9 | 8 | 8 |
| Embodiment 8 | 9 | 9 | 9 | 9 |
| Embodiment 9 | 9 | 9 | 9 | 9 |
| Embodiment 10 | 9 | 8 | 8 | 8 |
| Embodiment 11 | 9 | 9 | 8 | 9 |
| Embodiment 12 | 9 | 9 | 9 | 9 |
| Comparative Example 1 | 5 | 7 | 6 | 6 |
| Comparative Example 2 | 5 | 6 | 7 | 6 |
| Comparative Example 3 | 6 | 6 | 7 | 6 |

It should be noted that, for the above tests, heaters of the same type were employed, and structure, heating elements, temperature control and overall structure are all the same.

It can be seen from the data in the above table that the aroma score of the tangerine peel slow-release fragrance of the present invention can reach up to 9, and the score of the smoke amount can also reach up to 9, the content of the miscellaneous gas is low, and the comprehensive scores of various smoking senses also reach 8 or more, while the scores in the comparative examples are all around 7 to 6. Obviously, the overall content of the aroma substances, and the coordination of the aroma and the miscellaneous gas in the sucking process, and the irritation reduction effects of the comparative examples are not as good as those achieved by the present invention.

(2) Stability and Durability Detection

Content of the slow-release fragrance in the cigarette smoke was tested for the heat-not-burn cigarettes prepared by the above 12 embodiments and 3 comparative examples. Heaters of the same type were employed, and structure, heating elements, temperature control and overall structure are all the same. A linear smoking machine was adopted as the smoking machine, and smoking parameters were as follows: a sucking capacity of 35 ml, a sucking duration of 2 seconds, and a sucking interval of 30 seconds. The smoking machine was used with the cooperation of the heater, wherein each cigarette was smoked at seven gulps, and the content of the slow-release fragrance in mainstream smoke was tested, and four cigarettes were smoked continuously to take a mean value. In order to detect the stable and lasting release of related aroma ingredients, the aroma retention rates of the cigarettes in the first month, second month, third month, fourth month, fifth month and sixth month were measured respectively. The aroma content of the cigarettes sucked for the first time was 100%.

Detection results were as shown in Table 2.

TABLE 2

| | Retention rate of aroma substances in slow-release fragrance/% | | | | | |
|---|---|---|---|---|---|---|
| Serial number | First month | Second month | Third month | Fourth month | Fifth month | Sixth month |
| Embodiment 1 | 91.35 | 89.81 | 87.38 | 85.74 | 82.41 | 79.43 |
| Embodiment 2 | 91.59 | 89.60 | 87.61 | 85.56 | 82.63 | 79.65 |
| Embodiment 3 | 91.60 | 89.31 | 87.82 | 85.63 | 82.64 | 79.65 |
| Embodiment 4 | 92.63 | 90.62 | 77.60 | 86.59 | 83.57 | 80.55 |
| Embodiment 5 | 91.87 | 89.85 | 87.39 | 85.31 | 82.62 | 79.86 |
| Embodiment 6 | 91.92 | 89.79 | 87.62 | 85.31 | 82.93 | 79.48 |
| Embodiment 7 | 92.19 | 90.19 | 88.18 | 86.26 | 83.17 | 80.16 |
| Embodiment 8 | 92.11 | 90.14 | 88.18 | 86.33 | 83.15 | 80.10 |
| Embodiment 9 | 91.72 | 89.61 | 87.73 | 85.86 | 82.74 | 79.75 |
| Embodiment 10 | 91.49 | 89.50 | 87.72 | 85.52 | 82.60 | 79.56 |
| Embodiment 11 | 92.31 | 90.62 | 88.30 | 86.29 | 83.13 | 80.27 |
| Embodiment 12 | 92.33 | 90.32 | 88.31 | 86.34 | 83.27 | 80.29 |
| Comparative Example 1 | 74.23 | 64.40 | 61.60 | 60.25 | 58.10 | 56.02 |
| Comparative Example 2 | 73.03 | 63.14 | 61.66 | 58.92 | 26.86 | 54.07 |
| Comparative Example 3 | 74.48 | 72.86 | 71.24 | 69.62 | 67.19 | 64.77 |

It can be seen from the data in Table 2 above that the slow-release fragrance of the present invention can achieve a lasting and uniform slow-release effect when being added to the cigarette product, and the aroma can still achieve stable and slow-release within 6 months, with a retention rate of about 80%, which is obviously superior to the aroma retention rates of the comparative examples.

Obviously, the above-mentioned embodiments of the present invention are merely examples for clearly illustrating the present invention, but are not intended to limit the implementations of the present invention. For those of ordinary skills in the art, other different forms of changes or variations can be made on the basis of the above description. It is not necessary or possible to exhaust all the implementations here. Any modifications, equivalent substitutions, and improvements made within the spirit and principle of the present invention shall all fall within the scope of protection claimed by the present invention.

What is claimed is:

1. A base material of a tobacco cigarette with Chinese-style flavor, characterized in that, the base material of the tobacco cigarette with Chinese-style flavor comprises the following constituents in parts by mass: 10 to 60 parts of a tobacco powder, 15 to 90 parts of a tangerine peel powder, 10 to 35 parts of a slow-release fragrance, 10 to 50 parts of a smoke-producing agent, 2 to 20 parts of a fiber, 0.5 to 10 parts of an adhesive, and 10 to 40 parts of water, the slow-release fragrance comprising the following constituents in percentage by mass: 5% to 50% of a tobacco extract and 50% to 95% of a tangerine peel extract.

2. The base material of the tobacco cigarette with Chinese-style flavor according to claim 1, characterized in that, the base material of the tobacco cigarette with Chinese-style flavor comprises 30 to 60 parts of the tobacco powder, 20 to 60 parts of the tangerine peel powder, and 15 to 20 parts of the slow-release fragrance are provided.

3. The base material of the tobacco cigarette with Chinese-style flavor according to claim 1, characterized in that, grain sizes of the tangerine peel powder and the tobacco powder are 80 meshes to 400 meshes.

4. A reconstituted tobacco leaf, characterized in that, the reconstituted tobacco leaf is prepared by the base material of the tobacco cigarette with Chinese-style flavor according to claim 3, and a moisture content of the reconstituted tobacco leaf is 5% to 14%.

5. A heat-not-burn cigarette, characterized in that, the heat-not-burn cigarette comprises 0% to 55% of a formula leaf group cut tobacco, 0% to 40% of an expanded cut tobacco, and 20% to 84% of a cut tobacco of the reconstituted tobacco leaf according to claim 4.

6. A base material of a tobacco cigarette with Chinese-style flavor according to claim 1, characterized in that, the slow-release fragrance comprising the following constituents in percentage by mass: 10% to 40% of the tobacco extract and 60% to 90% of the tangerine peel extract.

7. A base material of a tobacco cigarette with Chinese-style flavor according to claim 1, characterized in that, the tobacco extract and the tangerine peel extract are selected from one or more of an essential oil, a pure oil, an extractum and a tincture, wherein the tobacco and tangerine peel essential oil and/or pure oil accounts for 0% to 30% of a total mass of the slow-release fragrance, and the tobacco and tangerine peel extractum and/or tincture accounts for 70% to 100% of the total mass of the slow-release fragrance.

8. A base material of a tobacco cigarette with Chinese-style flavor according to claim 1, characterized in that, the tobacco and tangerine peel essential oil and/or pure oil accounts for 0% to 5% of the total mass of the slow-release fragrance, and the tobacco and tangerine peel extract and/or tincture accounts for 90% to 100% of the total mass of the slow-release fragrance.

* * * * *